US008518618B2

(12) United States Patent
Iwamoto et al.

(10) Patent No.: US 8,518,618 B2
(45) **Date of Patent: *Aug. 27, 2013**

(54) ELECTROPHOTOGRAPHIC PHOTOCONDUCTOR, IMAGE FORMING APPARATUS, AND PROCESS CARTRIDGE

(75) Inventors: Takafumi Iwamoto, Shizuoka (JP); Naohiro Toda, Kanagawa (JP); Yoshitaka Uenoyama, Chiba (JP); Hidetoshi Ono, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

This patent is subject to a terminal disclaimer.

(21) Appl. No.: 13/171,794

(22) Filed: Jun. 29, 2011

(65) Prior Publication Data

US 2012/0009513 A1 Jan. 12, 2012

(30) Foreign Application Priority Data

Jul. 7, 2010 (JP) ..... 2010-154516

(51) Int. Cl.
*G03G 5/00* (2006.01)

(52) U.S. Cl.
USPC ..... 430/66; 399/159

(58) Field of Classification Search
USPC ..... 430/66; 399/159
See application file for complete search history.

(56) References Cited

U.S. PATENT DOCUMENTS

| | | | |
|---|---|---|---|
| 2008/0199217 | A1 | 8/2008 | Iwamoto et al. |
| 2008/0227008 | A1 | 9/2008 | Kami et al. |

FOREIGN PATENT DOCUMENTS

| | | |
|---|---|---|
| JP | 5-181299 | 7/1993 |
| JP | 2000-284514 | 10/2000 |
| JP | 2000-284515 | 10/2000 |
| JP | 2001-125286 | 5/2001 |
| JP | 3194392 | 6/2001 |
| JP | 2001-194813 | 7/2001 |
| JP | 2001-324857 | 11/2001 |
| JP | 2002-6526 | 1/2002 |
| JP | 2002-82465 | 3/2002 |
| JP | 2002-139859 | 5/2002 |
| JP | 2003-98708 | 4/2003 |
| JP | 2003-302779 | 10/2003 |
| JP | 2004-302451 | 10/2004 |
| JP | 2005-99688 | 4/2005 |
| JP | 2007-178815 | 7/2007 |
| JP | 2008-139824 | 6/2008 |
| JP | 2008-233893 | 10/2008 |

*Primary Examiner* — Mark A Chapman
(74) *Attorney, Agent, or Firm* — Oblon, Spivak, McClelland, Maier & Neustadt, L.L.P.

(57) ABSTRACT

To provide an electrophotographic photoconductor, containing: a conductive support; a photosensitive layer provided above the conductive support; and a hardened protective layer provided above the photosensitive layer, wherein the hardened protective layer contains a hardened product of a radical polymerizable compound containing an adamantane skeleton.

5 Claims, 2 Drawing Sheets

ELECTROPHOTOGRAPHIC PHOTOCONDUCTOR, IMAGE FORMING APPARATUS, AND PROCESS CARTRIDGE

BACKGROUND OF THE INVENTION

1. Field of the Invention

The present invention relates to an image forming apparatus, e.g. a photocopier, a laser printer, and facsimile, a process cartridge, and an electrophotographic photoconductor used in such image forming apparatus or process cartridge. Specifically, the present invention relates to an electrophotographic photoconductor that is excellent in stability of image qualities, and mechanical resistance (abrasion resistance), and a process cartridge for an image forming apparatus using such photoconductor, and an image forming apparatus using such photoconductor.

2. Description of the Related Art

Recently, organic photoconductors have been widely used as an electrophotographic photoconductor (may also referred to as a "photoconductor" hereinafter). The organic photoconductors have many advantages over inorganic photoconductors, such that it is easy to develop materials of the organic photoconductors corresponding to various exposure light from various light sources, from visible light to infrared light, a material that has less possibility to pollute the environment can be selected to form an organic photoconductor, and a production cost of an organic photoconductor is inexpensive. One of the disadvantages of the organic photoconductors over inorganic photoconductors is poor mechanical resistance. In view of effective use of resources, the photoconductor preferably has a long service life.

An electrophotographic image forming apparatus is generally equipped with an electrophotographic photoconductor, a charging unit for charging the electrophotographic photoconductor, a latent image forming unit for forming a latent static image on a surface of the electrophotographic photoconductor which has been charged by the charging unit, a developing unit for depositing a toner onto the latent static image formed by the latent image forming unit, a transferring unit for transferring the deposited toner to a transferring medium, a cleaning unit for removing the toner remained on the surface of the photoconductor without being transferred, and the like in the integrated manner.

By repeating each process such as the aforementioned charging, developing, transferring, and cleaning, a surface of the organic photoconductor chemically or physically deteriorates, and therefore the abrasion thereof is accelerated, which may cause formations of scratches. As a result, image quality of resulting prints is degraded in the early stage. Therefore, improvement of the mechanical resistance of the organic photoconductor has been one of the most important tasks. To achieve this, various technologies for providing a protective layer have been disclosed for the purpose of improving the mechanical resistance of the organic photoconductor.

For example, many techniques, in which a protective layer is provided on an outermost surface of a photoconductor, and inorganic particles were dispersed in the protective layer for improving the mechanical resistance, have been disclosed. As one example of such techniques, an electrophotographic photoconductor, which is formed by at least a photosensitive layer, and a protective layer containing filler are sequentially formed on a conductive support, is proposed in Japanese Patent Application Laid-Open (JP-A) No. 2002-139859, and the like. Moreover, as another approach to tackle this problem, various techniques for improving mechanical resistance of a photoconductor by increasing a hardness of a surface of the photoconductor have been disclosed. For example, it is proposed in JP-A Nos. 2001-125286, and 2001-324857 that a hardness of a protective layer of a photoconductor be increased for preventing the photoconductor from being scratched by magnetic particles pressed against the photoconductor at a transferring section or cleaning section, in the case where a magnetic blush is used as a charging unit and the magnetic particles forming the magnetic blush are unintentionally transferred onto the photoconductor. Moreover, it is proposed in JP-A No. 2003-098708 that a hardness of a photoconductor be increased for preventing abrasions of a surface of the photoconductor in the case where a blade cleaning system is employed. As specific methods for increasing a surface hardness of the photoconductor such as those mentioned above, it is proposed that a crosslinkable material such as a thermoset resin, and UV-curing resin be used as a component for forming a protective layer of the photoconductor. For example, a method for improving mechanical resistance, and scratch resistance of a protective layer using a thermoset resin as a binder component of the protective layer is proposed in JP-A Nos. 05-181299, 2002-006526, and 2002-082465. Moreover, such technique is disclosed in JP-A Nos. 2000-284514, 2000-284515, and 2001-194813 that a siloxane resin to which a group capable of giving a charge-transporting ability is contained in a protective layer to improve mechanical resistance and scratch resistance of a photoconductor. It is also disclosed in Japanese Patent (JP-B) No. 3194392 that a charge-transporting layer is prepared using a monomer having a carbon double bond (C═C), a charge-transporting material having a carbon double bond (C═C), and a binder resin for improving mechanical resistance and scratch resistance. In JP-A No. 2004-302451, a method for forming a charge-transporting layer by curing a tri- or higher functional radical polymerizable monomer having no charge-transporting structure and a monofunctional radical polymerizable compound having a charge-transporting structure is disclosed. Moreover, in JP-A No. 2005-99688, a method for forming a protective layer is disclosed, and in this method a protective layer is formed by curing a tri- or higher functional radical polymerizable monomer having no charge-transporting structure and a radical polymerizable compound having a charge-transporting structure, and dispersing filler therein. According methods as mentioned above, mechanical resistance of photoconductors have been significantly improved. Especially, a photoconductor in which a curable resin disclosed in JP-A Nos. 2004-302451 and 2005-99688 is used in a protective layer has excellent mechanical resistance and scratch resistance.

However, it is difficult to achieve a long service life of a photoconductor just by improving mechanical resistance thereof. To attain a long service light of a photoconductor, it is important to prevent depositions of foreign matters, and improve toner transferring rate.

At first, the depositions of foreign matters will be discussed. Even a photoconductor having excellent mechanical resistance may produce defected images after use for a long period. The cause of the defected images may be depositions of paper powder, or additives of the toner. The parts of the photoconductor where these depositions are present are not properly charged or exposed to light, which may cause formations of defected images. The photoconductor having poor mechanical resistance can prevents generations of defected images, as an outermost surface thereof tends to be abraded, but it is difficult for such photoconductor of poor mechanical resistance to attain a long service life. Accordingly, it is very important to prevent depositions of foreign matters.

The toner transferring rate will be explained next. If the toner transferring rate increases, wasteful use of the toner is prevented. When an amount of the residual toner after transferring (the toner remained on the photoconductor without being transferred after transferring to paper being performed) is large, load to a cleaning unit increases. As a result, an effect of cleaning does not last long, which shorten a service light of a process cartridge. Therefore, it is very important to increase the transferring rate of the toner.

Since the similar properties are related to the prevention of the depositions of foreign matters, and improvement of a toner transferring rate, the both are described as a releasing ability of a photoconductor here. To apply the releasing ability, it is effective to lower the energy of the outermost surface of the photoconductor. As a method for lowering the surface energy of the surface of the photoconductor, there are an external addition method, i.e. a method for externally applying a material for reducing the surface energy, and an internal addition method, i.e. a method for adding a material for reducing the surface energy into the film of the photoconductor. As the external addition method, a system for applying generally zinc stearate or the like onto a surface of the photoconductor has been known. To employ this system, a releasing ability can be provided to the surface of the photoconductor. However, a surface of the material for reducing the surface energy is deteriorated by electric discharge, which may cause formations of defected images. Moreover, providing this coating system increases the size of the image forming unit, which reduces the freedom of layout. Furthermore, the cost of the image forming unit also increases. The internal addition method for adding the material for reducing the surface energy into the film is also effective for improving the releasing ability. A photoconductor having a surface layer that uses a fluorine-substituted polysiloxane resin for providing a high releasing ability to the surface of the photoconductor is disclosed in JP-A No. 2007-178815. However, it has been known that the siloxane bond causes polarization, and therefore hydrogen bonds may be formed. Therefore, the adhesion thereof to the toner tends to be large under high humidity environment. For this reason, the releasing ability reduces under the high humidity environment. Moreover, to localize the material for reducing the surface energy at the surface, it is necessary to always abrade the surface of the photoconductor. Therefore, the mechanical resistance of the photoconductor is compromised.

Achievement of both the mechanical resistance and releasing ability will be explained. To achieve both the mechanical resistance and the releasing ability, it is necessary to combine both the aforementioned method for improving the mechanical resistance and the aforementioned method for providing the releasing ability. However, the material used for releasing ability (repellency) tends to also affect other resin material phases coexisted, and therefore attaining both the mechanical resistance and the releasing ability is not easy to achieve.

There is disclosed in JP-A No. 2002-6526 a photoconductor including a protective layer in which lubricating particles are contained. Moreover, there is disclosed in JP-A No. 2008-139824 a photoconductor including a surface protective layer formed of a hardened product of a fluorine-containing hardening composition containing a fluoroalkyl group-containing (meth)acrylate and a photopolymerization initiator. Furthermore, there is disclosed in JP-A No. 2008-233893 a photoconductor including a protective layer that is prepared by hardening a fluoro UV hardening hard coating agent and a radical polymerizable compound having a monofunctional charge-transporting structure, and moreover that contains lubricating particles. Using a fluoromaterial is an effective method for reducing the adhesion between a photoconductor and a toner. Especially by adding such material into the hardened protective layer, both mechanical resistance and reduction in adhesion between a photoconductor and a toner can be attained. However, a large amount of the fluoromaterial needs to be added to sufficiently reduce the adhesion. Since such fluoromaterial does not have a charge-transporting structure, the addition thereof in a large amount may increase electric potential in a blight region in a latent electric image. In addition, the film strength tends to reduce.

Moreover, in JP-A No. 2003-302779, there is a description about a photoconductor including a surface layer formed of a resin component containing 100 parts by mass of a polyester resin binder, and 60 parts by mass of a compound having an acryloyl group in a norbornene ring, that is a specific example of a compound having an alicyclic carbon ring having carbon atoms of 7 or more and a polymerizable functional group, and a charge-transporting material. Moreover, in JP-A No. 2003-302779, other examples of the compound having an alicyclic carbon ring having carbon atoms of 7 or more and a polymerizable functional group are listed. In this case, the mechanical strength of the resin is low as the resin and the binder resin a large amount of which is used are not crosslinked. Therefore, this is not appropriate for extending a service life of a photoconductor.

As has been mentioned above, it is difficult to attain both mechanical resistance and a high releasing ability of a photoconductor, and it is the current situation that an electrophotographic photoconductor is designed to achieve either of the aforementioned properties.

BRIEF SUMMARY OF THE INVENTION

The present invention aims at providing an electrophotographic photoconductor, which can achieve both mechanical resistance and high releasing ability, and is capable of stably outputting high quality image even after repeated use for a long period, as well as providing an image forming apparatus and a process cartridge both of which use such photoconductor.

The means for solving the aforementioned problems are as follows:

<1> An electrophotographic photoconductor, containing:

a conductive support;

a photosensitive layer provided above the conductive support; and a hardened protective layer provided above the photosensitive layer, wherein the hardened protective layer contains a hardened product of a radical polymerizable compound containing an adamantane skeleton.

<2> The electrophotographic photoconductor according to <1>, wherein the radical polymerizable compound containing an adamantane skeleton contains a fluorine atom in the adamantane skeleton.

<3> The electrophotographic photoconductor according to any of <1> or <2>, wherein the radical polymerizable compound containing an adamantane skeleton is a monofunctional or bifunctional compound.

<4> An image forming apparatus, containing:

the electrophotographic photoconductor as defined in any one of <1> to <3>;

a charging unit configured to charge a surface of the electrophotographic photoconductor;

an exposing unit configured to expose the charged surface of the electrophotographic photoconductor to light so as to form a latent electrostatic image;

a developing unit configured to develop the latent electrostatic image with a toner to form a visible image; and a transferring unit configured to transfer the visible image to a recording medium.

<5> A process cartridge containing:

the electrophotographic photoconductor as defined in any one of <1> to <3>; and at least one selected from the group consisting of a charging unit, an exposing unit, a developing unit, a transferring unit, and cleaning unit, which is mounted so as to be integrated with the electrophotographic photoconductor.

The present invention provides an electrophotographic photoconductor, which can achieve both mechanical resistance and high releasing ability, and is capable of stably outputting high quality image even after repeated use for a long period, as well as providing an image forming apparatus and a process cartridge both of which use such photoconductor.

DETAILED DESCRIPTION OF THE INVENTION (Electrophotographic Photoconductor)

The electrophotographic photoconductor of the present invention contains a conductive support, a photosensitive layer provided above the conductive support, and a hardened protective layer provided above the photosensitive layer, and may further contain other layers, if necessary.

Figure 1:
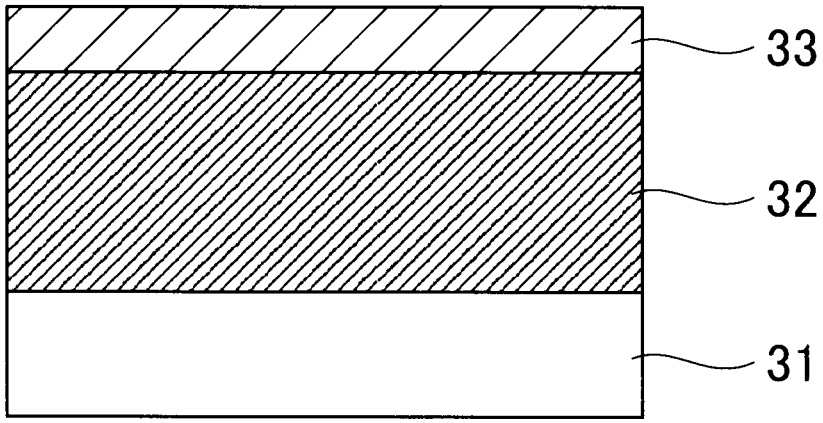
FIG. 1 is a cross-sectional diagram illustrating one example of a structure of the electrophotographic photoconductor of the present invention.

The present embodiment of the photoconductor has a laminate structure where at least the photosensitive layer 32, and the hardened protective layer 33 are laminated on the conductive support 31 in this order, as illustrated in FIG. 1.

<Conductive Support>

The conductive support is selected from those having a conductivity of $10^{10}$ Ω·cm or less based on the volume resistivity. Examples of such conductive support include: a film-shaped or cylindrical plastic or paper coated with a metal (e.g. aluminum, nickel, chromium, nichrome, copper, gold, silver, platinum) or a metal oxide (e.g. tin oxide, indium oxide) by vacuum deposition or sputtering; and a tube which is formed by forming one or more plates of aluminum, aluminum alloy, nickel, stainless steel into a tube by extrusion, or drawing out, then subjecting the tube to surface treatment such as cutting, super-finishing, and polishing. Moreover, an endless nickel belt, and an endless stainless steel belt disclosed in JP-A No. 52-36016 can be also used as the conductive support.

Other than those listed above, one formed by coating a conductive powder, which is dispersed in an appropriate binder resin, onto the aforementioned support can also be used as the conductive support of the present invention. Examples of the conductive powder include: organic powder such as carbon black, acetylene black; metal powder such as aluminum, nickel, iron, nichrome, copper, zinc, and silver; and metal oxide powder such as conductive tin oxide, and ITO.

Examples of the binder resin used together with the conductive powder include thermoplastic resins, thermocrosslinkable resins, and photocurable resins, and specific examples thereof include polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyacrylate resins, phenoxy resins, polycarbonate, cellulose acetate resins, ethyl cellulose resins, polyvinyl butyral, polyvinyl formal, polyvinyl toluene, poly-N-vinyl carbazole, acrylic resins, silicone resins, epoxy resins, melamine resins, urethane resins, phenol resins, and alkyd resins. Such conductive layer can be provided by coating a coating liquid prepared by dispersing these conductive powder and binder resin in an appropriate solvent such as tetrahydrofuran, dichloromethane, methylethyl ketone, and toluene.

Furthermore, as the conductive support for use in the present invention, a support in which a conductive layer is provided on an appropriate cylindrical support by using a thermal shrinkable tube formed of a material (e.g. polyvinyl chloride, polypropylene, polyester, polystyrene, polyvinylidene chloride, polyethylene, chlorinated rubber, and polytetrafluoroethylene-based fluororesin) to which the aforementioned conductive powder is added may be also suitably used.

<Photosensitive Layer>

The photosensitive layer will be explained next. The photosensitive layer may be of a single layer, or a laminate of two or more layers, but the laminate photosensitive layer will be explained first. The laminate photosensitive layer is formed by laminating at least a charge-generating layer and a charge-transporting layer.

<Charge-Generating Layer>

The charge-generating layer is a layer mainly formed of a charge-generating material having charge-generating ability, and may further contain a binder resin in combination with the charge-generating material, if necessary.

The charge-generating layer is a layer mainly formed of a charge-generating material. Various charge-generating materials known in the art can be used in the charge-generating layer. Examples of such charge-generating material include: azo pigments such as monoazo pigments, disazo pigments, asymmetric disazo pigments, trisazo pigments, azo pigments having a carbazole skelton (disclosed in JP-A No. 53-95033), azo pigments having a distyrylbenzene skeleton (disclosed in JP-A No. 53-133445), azo pigments having a triphenyl amine skeleton (disclosed in 53-132347), azo pigments having a diphenyl amine skeleton, azo pigments having a dibenzothiophene skeleton (disclosed in JP-A No. 54-21728), azo pigments having a fluorenone skeleton (disclosed in JP-A No. 54-22834), azo pigments having an oxadiazole skeleton (disclosed in JP-A No. 54-12742), azo pigments having a bisstilbene skeleton (disclosed in JP-A No. 54-17733), azo pigments having a distyryloxadiazole skeleton (disclosed in JP-A No. 54-2129), azo pigments having a distyryl carbazole skeleton (disclosed in JP-A No. 54-14967); azulenium salt pigments; quadratic acid methane pigments; perylene pigments; anthraquinone or polycyclic quinone pigments; quinone-imine pigments; diphenyl methane pigments and triphenyl methane pigment; benzoquinone pigments and naphtoquinone pigments; cyanine pigments and azomethine pigments; indigoid pigments; bisbenzoimidazole pigments; and phthalocyanine pigments such as metal phthalocyanine expressed by the following general formula 7, and a nonmetallic phthalocyanine. These charge-generating materials may be used independently or in combination.

Examples of the binder resin optionally used in the charge-generating layer include polyamide, polyurethane, epoxy resin, polyketone, polycarbonate, silicone resin, acrylic resin, polyvinyl butyral, polyvinyl formal, polyvinyl ketone, polystyrene, poly-N-vinyl carbazole, polyacryl amide, polyvinyl benzal, polyester, phenoxy resins, vinyl chloride-vinyl acetate copolymers, polyvinyl acetate, polyphenylene oxide, polyvinyl pyridine, cellulose resin, casein, polyvinyl alcohol, and polyvinyl pyrrolidone. These binder resins may be used independently, or in combination.

The amount of the binder resin for use is preferably 0 parts by mass to 500 parts by mass, more preferably 10 parts by mass to 300 parts by mass, relative to 100 parts by mass of the charge-generating material. The binder resin may be added before or after dispersing the charge-generating material.

Moreover, examples of a solvent for use for forming the charge-generating layer include commonly used organic solvents, such as isopropanol, acetone, methylethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. Among them, the ketone solvent, ester solvent, and ether solvent are preferably used. These may be used independently, or in combination.

For forming the charge-generating layer, a coating liquid can be prepared by dispersing the charge-generating material, optionally together with the binder resin, in the solvent, in accordance with any of conventional dispersing methods known in the art, such as using a ball-mill, an attritor, a sand-mill or ultrasonic waves. Note that, the binder resin may be added after or before dispersing the charge-generating material. The coating liquid of the charge-generating layer contains the charge-generating material, the solvent and the binder resin as main components, and may further contain additives such as a sensitizing agent, a dispersing agent, a surfactant, and silicone oil. In some cases, it is also possible to add a charge-transporting material, which will be explained later, to the charge-generating layer. The amount of the binder resin for use is preferably 0 part by mass to 500 parts by mass, more preferably 10 parts by mass to 300 parts by mass, relative to 100 parts by mass of the charge-generating material.

The charge-generating layer is formed by applying the coating liquid on the conductive support or undercoat layer, and drying. The coating method for the application of the coating liquid may be selected from conventional methods known in the art, such as dip coating, spray coating, bead coating, nozzle coating, spinner coating, and ring coating. The thickness of the charge-generating layer is preferably 0.01 μm to 5 μm, more preferably 0.1 μm to 2 μm. Moreover, drying after the application of the coating liquid is performed by heat drying using an oven or the like. The drying temperature of the charge-generating layer is preferably 50° C. to 160° C., more preferably 80° C. to 140° C.

<Charge-Transporting Layer>

The charge-transporting layer is a layer having a charge-transporting structure, and is mainly formed of a charge-transporting material and a binder resin.

The charge-transporting layer contains a hole-transporting material as the charge-transporting material, and may further contain an electron-transporting material, if necessary. Various examples are described below. Note that, the "charge-transporting material" means both an "electron-transporting material" and a "hole-transporting material."

Examples of the electron-transporting material include an electron-accepting compounds such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-on, 1,3,7-trinitrodibenzothiophene-5,5-dioxide, diphenoquinone derivatives, and naphthalenetetracarboxylic acid diimide derivatives. These electron-transporting materials may be used independently, or in combination.

Examples of the hole-transporting material include poly-N-vinyl carbazole and derivatives thereof, poly-γ-carbazolylethyl glutamate and derivatives thereof, a pyrene-formaldehyde condensate and derivatives thereof, polyvinyl pyrene, polyvinyl phenanthrene, polysilane, oxazole derivatives, oxadiazole derivatives, imidazole derivatives, monoarylamine derivatives, diarylamine derivatives, stilbene derivatives, α-phenyl stilbene derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, distyryl derivatives, enamine derivatives, and other materials known in the art. These hole-transporting materials may be used independently or in combination. Among the charge-transporting materials contained in the charge-transporting layer, those having a triarylamine structure are advantageous for charge transfer.

Examples of the binder resin include thermoplastic resins and thermoset resins, such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyacrylate, phenoxy resins, polycarbonate, cellulose acetate resins, ethyl cellulose resins, polyvinyl butyral, polyvinyl formal, polyvinyl toluene, poly (N-vinylcarbazole), acrylic resins, silicone resins, epoxy resins, melamine resins, urethane resins, phenol resins, and alkyd resins.

The amount of the charge-transporting material is preferably 20 parts by mass to 300 parts by mass, more preferably 40 parts by mass to 150 parts by mass, relative to 100 parts by mass of the binder resin.

Examples of the solvent for use here include tetrahydrofuran, dioxane, toluene, dichloromethane, monochlorobenzene, dichloroethane, cyclohexanone, methylethyl ketone, and acetone. These may be used independently, or in combination.

Moreover, a plasticizer, and a leveling agent may be added to the charge-transporting layer, if necessary. As the plasticizer for used in the charge-transporting layer, common plasticizers such as dibutyl phthalate, and dioctyl phthalate are used as they are, and the appropriate amount of the plasticizer for use is in the approximate range of 0 part by mass to 30 parts by mass, relative to 100 parts by mass of the binder resin. Examples of the leveling agent for use in the charge-transporting layer include: silicone oils such as dimethyl silicone oil, and methylphenyl silicone oil; and polymers or oligomers each having a perfluoroalkyl group in the side chain. The appropriate amount of the leveling agent for use is in the approximate range of 0 part by mass to 1 part by mass, relative to the 100 parts by mass of the binder resin.

The thickness of the charge-transporting layer is preferably 30 or smaller, and more preferably 25 μm or smaller, for attaining desirable dissolution and response. The lowest limit of the thickness thereof varies depending on a system for use (particularly, charged potential), but it is preferably 5 μm or larger.

<Photosensitive Layer of Single Layer>

A photosensitive layer having a single layer structure can be used in the electrophotographic photoconductor of the present invention. The photosensitive layer is formed by dissolving or dispersing the aforementioned charge-generating material, the charge-transporting material, the binder resin and the like in an appropriate solvent, applying the resultant onto the conductive support or the undercoat layer, and drying the same. As the charge-generating material and the charge-transporting material (i.e. the electron-transporting material and the hole-transporting material), those listed in the descriptions of the charge-generating layer and the charge-transporting layer can be used. Moreover, as the binder resin for use, the resin listed in the description of the charge-transporting layer, as well as a mixture of such resin and the resin listed in the description of the charge-generating layer may be used. An amount of the charge-generating material is preferably 5 parts by mass to 40 parts by mass, more preferably 10 parts by mass to 30 parts by mass, relative to 100 parts by mass of the binder resin, and an amount of the charge-transporting material is preferably 0 part by mass to 190 parts by mass, more preferably 50 parts by mass to 150 parts by mass, relative to 100 parts by mass of the binder resin. The photosensitive layer can be formed by dissolving or dispersing the charge-generating material, and the binder resin together with the electron-transferring material, in a solving (e.g. tetrahydrofuran, dioxane, dichloroethane, cyclohexane, toluene, methylethyl ketone, and acetone) and applying the resultant by a coating method such as dip coating, spray coating, bead coating and ring coating. Moreover, various additives (e.g. a plasticizer, a leveling agent, an antioxidant, and a lubricant) can be added, if necessary. The thickness of the photosensitive layer is preferably 5 μm to 25 μm.

<Hardened Protective Layer>

The materials for forming the hardened protective layer will be explained next.

The hardened protective layer includes a hardened product of a radical polymerizable compound containing an adamantane skeleton.

The hardening is a reaction for forming a three-dimensional structure, generally owing to an intermolecular reaction of a low molecular compound having a plurality of functional groups, or bonding between the molecules of a high molecular compound initiated by the application of energy such as heat, light, electron beams, and the like.

The radical polymerizable compound containing an adamantane skeleton will be explained hereinafter.

The adamantane has a structure in which four cyclohexane rings are condensed in the shape of a basket.

The adamantane is a highly symmetric and stable skeleton.

The adamantane skeleton can be prepared by isomerizing a compound (e.g. trimethylene norbornane[tetrahydrodichloropentadiene], perhydroacenaphthene, perhydrofluorene, perhydrophenalene, 1,2-cyclopentanoperhydronaphthalene, perhydroanthracene, perhydrophenanthrene, and alkyl-substituted compounds thereof), for example, 9-methylperhydroanthracene, as disclosed in JP-A No. 2002-302462.

The radical polymerizable compound containing an adamantane skeleton for use in the present invention means a monomer, which does not contain a hole-transporting structure (e.g. triaryl amine, hydrazone, pyrazoline, and carbazole) and an electron-transporting structure (e.g. condensed polycyclic quinone, diphenoquinone, and an electron-withdrawing aromatic ring having a cyano group or nitro group), but has an adamantane skeleton and a radical polymerizable functional group. The radical polymerizable group contained in the radical polymerizable compound containing an adamantane skeleton for use in the present invention is preferably an acryloyl group in view of its reactivity. Moreover, the radical polymerizable compound containing an adamantane skeleton is preferably of monofunctional or bifunctional in view of the hardening reaction (curing reaction) thereof, as the resulting film has excellent abrasion resistance and releasing properties. Moreover, the adamantane skeleton contained in the radical polymerizable compound is preferably the same, because such compound is excellent in compatibility to other materials for forming the hardened layer, and a uniform film can be obtained as a result.

The radical polymerizable monomer (compound) containing an adamantane skeleton can be prepared by subjecting alcohol containing an adamantane skeleton (e.g., 1-adamantanol, 1,3-adamantane diol, 1-adamantanemethanol, 1,3-adamantane dimethanol, 1-adamantaneethanol, and 1,3-adamantane diethanol), acrylic acid, and methacrylic acid to azetropic distillation for dehydration under the refluxed solvent. As disclosed in JP-A No. 2004-123687, a radical polymerizable compound containing an adamantane skeleton in which a hydrogen atom has been substituted with a fluorine atom can be prepared by subjecting perfluoroadamantals, acrylic acid, and methacrylic acid to azetropic distillation for dehydration under the refluxed solvent. Examples of the perfluoroadamantals used here include perfluoro-1-adamantal, perfluoro-1,3-adamantane diol, perfluoro-1-adamantane methanol, perfluoro-1,3-adamantane dimethanol, perfluoro-1-adamantane ethanol, perfluoro-1,3-adamantane diethanol, 1-(2-hydroxyethoxy)perfluoroadamantane, and 1,3-bis(2-hydroxyethoxy)perfluoroadamantane. As a reaction solvent for these, toluene, xylene, and the like are suitably used.

The reaction conditions are the same as in a common azetropic distillation process, and a reaction temperature is in the range of −78° C. to 200° C., preferably the temperature identical to the boiling point of the solvent for use at the reaction pressure. The reaction pressure is 0.1 MPa to 10 MPa, and the reaction duration is 1 hour to 24 hours, preferably 3 hours to 6 hours. Moreover, the concentration of the raw material in the reaction solvent is not particularly limited as long as it is at the saturated solubility or lower, but it is preferably 0.5 mol/L to 1.0 mol/L.

The present invention has realized improvements of the mechanical resistance and releasing ability of the photoconductor, because the adamantane has rigidness and lubricity owing to its skeleton. For this reason, it is presumed that the resulting film can be avoided from the disadvantages generally observed from the use of a lubrication compound added therein, such as deterioration in the properties of the photoconductor due to a large amount of such compound added thereto, and necessity of a surface renewing treatment (abrasion treatment) for always exposing the lubricant to the surface. Moreover, the radical polymerization compound containing an adamantane skeleton in which the hydrogen atom has been substituted with a fluorine atom gives higher lubricity. This is because that lubricity effect of the fluorine is added to the effect originated from the skeleton.

Moreover, the hardened protective layer may contain a charge-transporting material, which is used in a charge-transporting layer that will be explained later. Such material may be selected from compounds having both a charge-transporting structure and a radical polymerizable functional group.

The charge-transporting structure means a hole-transporting structure (e.g. triaryl amine, hydrazone, pyrazoline, and carbazole) and an electron-transporting structure (e.g. condensed polycyclic quinone, diphenoquinone, and an electron-withdrawing aromatic ring having a cyano group or nitro group).

The radical polymerizable functional group is not particularly restricted, as long as it is a group having a carbon double bond (C=C), and capable of radical polymerization. Examples of such radical polymerizable functional group include 1-substituted ethylene functional group, and 1,1-substituted ethylene functional group.

(1) 1-substituted Ethylene Functional Group

Examples of the 1-substituted ethylene functional group include a functional group expressed by the following formula 10:

$$CH_2{=}CH{-}X_1{-} \qquad \text{Formula 10}$$

In the formula above, $X_1$ is a substituted or unsubstituted arylene group (e.g. a phenylene group and a naphthylene group); a substituted or unsubstituted alkenylene group; —CO— group; —COO— group; —$CONR_{78}$ group, where $R_{78}$ is a hydrogen atom, an alkyl group (e.g. a methyl group and ethyl group), an aralkyl group (e.g. a benzyl group, a naphthyl methyl group, and a phenethyl group), or an aryl group (e.g. a phenyl group, and a naphthyl group); or S— group.

Specific examples of the aforementioned substituent include a vinyl group, a styryl group, a 2-methyl-1,3-butadienyl group, a vinylcarbonyl group, an acryloyloxy group, an acryloylamide group, and a vinylthioether group.

(2) 1,1-substituted ethylene Functional Group

Examples of the 1,1-substituted ethylene functional group include a functional group expressed by the following formula 11:

$$CH_2{=}CY{-}X_2{-} \qquad \text{Formula 11}$$

In the formula above, Y is a substituted or unsubstituted alkyl group, a substituted or unsubstituted aralkyl group, a substituted or unsubstituted aryl group (e.g. a phenyl group, and a naphthyl group), a halogen atom, a cyano group, a nitro group, an alkoxy group (e.g. a methoxy group, and an ethoxy group), —$COOR_{79}$ group ($R_{79}$ is a hydrogen atom, a substituted or unsubstituted alkyl group (e.g. a methyl group, and an ethyl group), a substituted or unsubstituted aralkyl group (a benzyl group, and a phenethyl group), a substituted or unsubstituted aryl group (e.g. a phenyl group, and a naphthyl group), or $CONR_{80}R_{81}$ ($R_{80}$ and $R_{81}$ are each identically or independently a hydrogen atom, a substituted or unsubstituted alkyl group (e.g. a methyl group, and an ethyl group), a substituted or unsubstituted aralkyl group (e.g. a benzyl group, a naphthylmethyl group, and a phenethyl group), or a substituted or unsubstituted aryl group (e.g. a phenyl group, and a naphthyl group)); and $X_2$ is a substituent identical to $X_1$ of the Formula 10 above, a single bond, or an alkylene group, with proviso that at least either Y or $X_2$ is an oxycarbonyl group, a cyano group, an alkenylene group, or an aromatic ring.

Specific examples of such substituent include an α-chloro acryloyloxy group, a methacryloyloxy group, an α-cyanoethylene group, an α-cyanoacryloyloxy group, an α-cyanophenylene group, and a methacryloyl amino group.

Examples of a substituent that may further substitute part of the substituent such as $X_1$, $X_2$, and Y include: a halogen atom; a nitro group; a cyano group; an alkyl group such as a methyl group, and an ethyl group; an alkoxy group such as a methoxy group, and an ethoxy group; an aryloxy group such as a phenoxy group; an aryl group such as a phenyl group and a naphthyl group; and an aralkyl group such as a benzyl group, and a phenethyl group.

The acryloyloxy group and the methacryloyloxy group are particularly effective among these radical polymerizable functional groups.

The compound having the acryloyloxy group can be prepared, for example, by an ester reaction, or transesterification using a compound having a hydroxyl group in a molecule thereof, acrylic acid (salt), acrylic acid halide, and acrylic acid ester. Moreover, the compound having the methacryloyloxy group can be prepared in the same manner. In the case of a monomer having a plurality of radical polymerizable functional groups, these radical polymerizable functional groups may be identical or different.

In the case where the hardened protective layer contains the charge-transporting material, an amount of the charge-transporting material is preferably 20% by mass to 80% by mass, more preferably 30% by mass to 70% by mass relative to total amount of the hardened protective layer.

Specific examples of the radical polymerizable compound containing an adamantane skeleton used in the hardened protective layer are shown below, but the radical polymerizable compound containing an adamantane skeleton used in the present invention are not limited to the examples below.

Adamantane 1

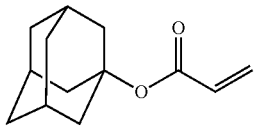

Adamantane 2

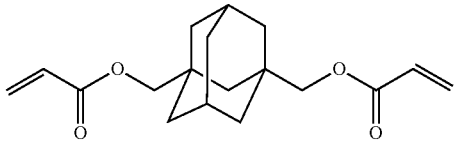

Adamantane 3

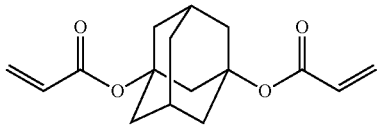

Adamantane 4

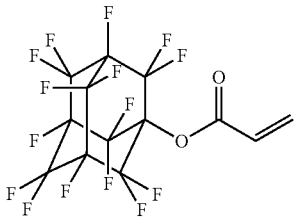

Adamantane 5

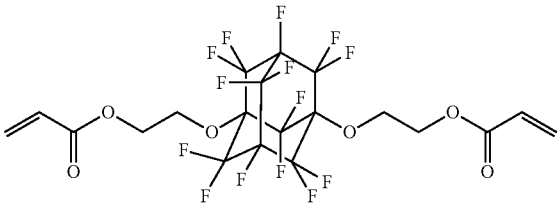

-continued

Adamantane 6

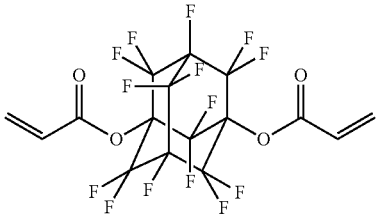

As can be understood from the structures of Adamantanes 1, 2, 3, 4, 5 and 6 above, Adamantanes 1, 2, 3, 4, 5 and 6 are abbreviations for a radical polymerizable compounds containing an adamantane skeleton 1, 2, 3, 4, 5 and 6.

The hardened protective layer may contain filler (filler particles) for the purpose of improving abrasion resistance, and providing functions.

The addition of the filler to the hardened protective layer enhances the abrasion resistance of the resin part, which prevents uneven abrasion. In addition to this, the filler is prevented from being fallen off, as the filler particles dispersed in the resin are entrapped in a crosslinked matrix of the hardened resin, and the crosslinked matrix has a large ability to retain the filler particles therein. Accordingly, the abrasion resistance of the resulting photoconductor is significantly improved. Moreover, an addition of conductive filler can provide a film with a charge-transporting ability.

The following materials can be used as the filler particles. Specifically, examples of the organic filler material include: fluororesin powder such as polytetrafluoroethylene; silicone resin powder; and carbon particles. The carbon particles are particles having the structures mainly formed of carbon, such as amorphous, diamond, graphite, fullerene, a Zeppelin-shape, carbon nanotube, and carbon nanohorn. Among particles having these structures, particles having the diamond-like carbon structure containing hydrogen, or particles having the amorphous carbon structure are preferable as theny have desirable mechanical and chemical resistance. The diamond-like carbon containing hydrogen, or the amorphous carbon structure is referred to here as particles in each of which similar structures, such as a diamond structure having a sp3 hybrid orbital, a graphite structure having a sp2 hybrid orbital, and an amorphous carbon structure, coexist. The diamond-like carbon or amorphous carbon particles are not formed of only carbons, and may further contains other elements such as hydrogen, oxygen, nitrogen, fluorine, boron, phosphorus, chlorine, bromine, and iodine.

Examples of the inorganic filler include: metal powder such as copper, tin, aluminum, and indium; metal oxides such as silicon oxide, tin oxide, zinc oxide, aluminum oxide, titanium oxide, indium oxide, antimony oxide, and bismuth oxide; and inorganic materials such as potassium titanate. Among them, use of the inorganic materials is particularly advantageous in view of the hardness of the resulting filler. The metal oxide is particularly preferably used, and moreover, silicon oxide, aluminum oxide, and titanium oxide are effectively used. Moreover, fine particles such as colloidal silica, and colloidal alumina are also effectively used.

The average primary particle diameter of the filler is preferably 0.01 μm to 0.9 μm for attaining the hardened protective layer having the desirable light transmittance and abrasion resistance, more preferably 0.1 μm to 0.5 μm. The filler having the average primary particle diameter of smaller than 0.01 μm leads to low abrasion resistance of the resulting protective layer, and low dispersibility of the filler. The filler having the average primary particle diameter of larger than 0.9 μm leads to a probability that the sedimentation of the filler is accelerated in the dispersion liquid.

With regard to the amount of the filler used in the hardened protective layer, the larger the amount is the higher abrasion resistance of the protective layer is provided. However, in the case where the concentration thereof is excessively large, adverse effects may be caused thereby, such as increase in the residual potential, and decrease in light transmittance of the surface layer with respect to the wiring light. For these reasons, the amount of the filler is approximately 50% by mass or lower, preferably approximately 30% by mass or lower relative to the total solid content. Moreover, it is possible to subject the filler to a surface treatment with at least one surface treating agent, and use of such surface-treated filler is preferable in view of the dispersibility of the filler. Low dispersibility of the filler causes not only increase in the residual potential, but also decrease in transparency of the coated film, defects in the coated film, and moreover reduction in the abrasion resistance. Therefore, this may develop to more severe problems that impede the indented accomplishments of the resulting photoconductor, such as providing high resistance and high image quality.

The hardened protective layer is hardened (cured) at once using at least one selected from the group consisting of heat, light, and ionizing radiation. In the case where the hardened protective layer is formed using thermal energy or light energy, a polymerization initiator may be optionally added to the hardened protective layer for improving the efficiency of a crosslinking reaction. In the case where the crosslinking is carried out using the ionizing radiation, it is generally possible to initiate a crosslinking reaction without using a polymerization initiator, and it is also possible to apply thermal energy and/or light energy to the hardened protective layer as a post-treatment, for curing uncured components remained after the application of the ionizing radiation. In such case, it is also effective to add the polymerization initiator, listed below.

Examples of the thermal polymerization initiator include: peroxide initiators, such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide, t-butylhydroperoxide, cumene hydroperoxide, and lauroyl peroxide; and azo initiators such as azobis isobutyl nitrile, azobiscyclohexane carbonitrile, azobis methyl isobutylate, azobisisobutylamidine hydrochloride, and 4,4'-azobis-4-cyanovaleric acid.

Examples of the photopolymerization initiator include: acetophenone or ketal photopolymerization initiators, such as diethoxyacetophenone, 2,2-dimethoxy-1,2-diphenylethan-1-on, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1, 2-hydroxy-2-methyl-1-phenylpropan-1-on, 2-methyl-2-morpholino(4-methylthiophenyl)propan-1-on, and 1-phenyl-1,2-propanedione-2-(o-ethoxycarbonyl)oxime; benzoin photopolymerization initiators such as benzoin; benzoin ether photopolymerization initiators, such as benzoin methyl ether, benzoin ethyl ether, benzoin isobutyl ether, and benzoin isopropyl ether; benzophenone photopolymerization initiators, such as benzophenone, 4-hydroxybenzophenone, methyl o-benzoyl benzoate, 2-benzoyl naphthalene, 4-benzoyl biphenyl, 4-benzoyl phenyl ether, acrylated benzophenone, and 1,4-benzoyl benzene; thioxanthone photopolymerization initiators, such as 2-isopropylthioxanthone, 2-chlorothioxanthone, 2,4-dimethylthioxanthone, 2,4-diethylthioxanthone, and 2,4-dichlorothioxanthone; titanocene photopolymerization initiators, such as bis(cyclopentanedienyl)-di-chloro-titanium, bis(cyclopentanedienyl)-di-phenyl-titanium, bis(cyclopentanedienyl)-bis(2,3,4,5,6-pentafluorophenyl)titanium, and bis(cyclopentadienyl)-bis(2,6-difluoro-3-(pyrrol-1-yl)phenyl)titanium; and other photopolymerization initiators such as ethyl anthraquinone, 2,4,6-trimethylbenzoyldiphenyl phosphine oxide, 2,4,6-trimethylbenzoylphenylethoxy phosphine oxide, bis(2,4,6-trimethylbenzoyDphenylphosphine oxide, bis(2,4-dimethoxybenzoyl)-2,4,4-trimethylpentyl phosphine oxide, methylphenylglyoxy ester, 9,10-phenanthrene, acridine compounds, triazine compounds, and imidazole compounds.

Moreover, a compound having an effect of accelerating photopolymerization can be used independently, or in combination with the aforementioned photopolymerization initiator. Examples of such compound include triethanol amine, methyldiethanol amine, ethyl 4-dimethylamino benzoate, isoamyl 4-dimethylamino benzoate, (2-dimethylamino)ethyl benzoate, and 4,4'-dimethylamino benzophenone. These polymerization initiators may be used independently, or in combination. An amount of the polymerization initiator is preferably 0.5 parts by mass to 40 parts by mass, more preferably 1 part by mass to 20 parts by mass, relative to 100 parts by mass of all of the contents having radical polymerizable properties.

<Other Additives>

The hardened protective layer may further contain other various additives, such as a plasticizer (for releasing pressure, and improving adhesion), a leveling agent, a low molecular charge-transporting material, and the like, if necessary. These additives can be selected from those known in the art. As the plasticizer, such plasticizers commonly used in resins can be used here, and examples thereof include dibutylphthalate, and dioctylphthalate. Amount of the plasticizer for use is 20 parts by mass or less, preferably 10 parts by mass or less relative to 100 parts by mass of the total solid content contained in the coating liquid. Examples of the leveling agent include: silicone oils such as dimethyl silicone oil, and methylphenyl silicone oil; and polymers or oligomers, each having a perfluoroalkyl group in a side chain thereof. An amount of the leveling agent for use is preferably 3 parts by mass or less relative to 100 parts by mass of the total solid content in the coating liquid.

The hardened protective layer is formed by applying the coating liquid containing the radical polymerizable compound containing an adamantane skeleton onto the aforementioned photosensitive layer, and hardening (curing) the applied coating liquid.

In the case where the radical polymerizable compound is in the form of fluid, the coating liquid used for coating is prepared by dissolving other components in such fluid, and the resulting coating liquid can be applied for coating. If necessary, such coating liquid is diluted with a solvent and then applied. The solvent used is not particularly restricted, provided that it is a solvent commonly used. Examples of such solvent include: alcohols such as methanol, ethanol, propanol, and butanol; ketones such as acetone, methylethyl ketone, methyl isobutyl ketone, and cyclohexanone; esters such as ethyl acetate, and butyl acetate; ethers such as tetrahydrofuran, dioxane, and propyl ether; halogen solvents such as dichloromethane, dichloroethane, trichloroethane, and chlorobenzene; aromatic solvents such as benzene, toluene, and xylene; and cellosolves such as methyl cellosolve, ethyl cellosolve, and cellosolve acetate. These solvents may be used independently or in combination.

The coating method used for forming the hardened protective layer is not particularly restricted, as long as it is a commonly used coating method. The coating method can be appropriately selected depending on the viscosity of the coating liquid, intended thickness of the hardened protective layer to be formed, and the like. Examples thereof include dip coating, spray coating, bead coating, and ring coating.

In the present embodiment, the hardened protective layer is hardened (cured), after applying the coating liquid, by externally applying energy. The external energy used here can be selected from thermal energy, light energy, and energy using ionizing radiation. The hardened protective layer is preferably hardened (cured) using the thermal energy or light energy, since use of the ionizing radiation may cause deteriorations of the material for forming the electrophotographic photoconductor due to the depth the energy reaches, and intensity of the energy, which may lower the properties of the resulting electrophotographic photoconductor. More preferably, the hardening is carried out using the light energy, as use of the light energy can expect the reduction in an amount of the solvent used during the production, reduction in the energy required for crosslinking, and enhancement of the strength of the resulting crosslinked film. Furthermore, two of any of this energy may be used in combination for efficiently performing crosslinking.

As the thermal energy, gas such as air and nitrogen, vapor, various heating media, infrared rays, and electromagnetic waves can be used, and the application thereof can be performed by heating the applied protective layer from the coating side, or side of the support. The heating temperature is preferably 100° C. to 170° C. When the heating temperature is lower than 100° C., the productivity is low as the reaction speed is slow, which may become a cause of unreacted materials remained in the resulting film. In the case where heating is performed at the temperature higher than 170° C., the film largely shrinks due to crosslinking, which may cause surface defects, e.g. roughness of the surface, like a surface texture of an orange zest, cracks, or peeling at the interface with the adjacent layer. Moreover, in the case where the volatile substances contained in the photosensitive layer is released outside the layer because of the pealing of the protective layer, the desirable electric properties of the resulting photoconductor cannot be attained, and therefore it is not preferable. At the time when the resin that largely shrinks by crosslinking is used, it is effective that primary crosslinking is performed at the low temperature of lower than 100° C., then the crosslinking is completed at the high temperature of 100° C. or higher.

As the light energy, light sources such as an ultra-high pressure mercury lamp, a high pressure mercury lamp, a carbon arc lamp, and a xenon arc metal halide lamp can be used, and it is preferred that the light source be appropriately selected depending on a radical polymerizable compound having no electron-transporting structure or radical polymerizable compound (preferably monofunctional) having a charge-transporting structure for use, moreover depending on absorption properties of the photopolymerization initiator for use in combination. With regard to the luminance of the light source for use, it is preferred that the radiation be performed at the luminance of 50 mW/cm$^2$ to 2,000 mW/cm$^2$ generally based on a wavelength of 365 nm. Moreover, in the case where the measurement of the luminance is possible at the wavelength around the wavelength where the maximum emission peak of the light from the light source is observed, it is more preferred that the radiation be performed at the aforementioned luminance range. When the luminance is low, the time required for hardening is long, and therefore it is not preferable in view of productivity. When the luminance is high, shrinkage of the film tends to occur at the time of the hardening, which may cause surface defects, e.g. roughness of the surface, like a surface texture of an orange zest, cracks, or peeling at the interface with the adjacent layer.

The ionizing radiation is a radiation capable of ionizing a material, and examples thereof include: direct ionizing radiation such as α rays, and electron beams; and indirect ionizing radiation such as X rays and neutron beams. The ionizing radiation for use in the present invention is not particularly restricted as long as it is a commonly used ionizing radiation, but it is preferably electron beams in view of potential effect to human bodies. As an irradiation equipment of the electron beams, devices using various electron beam accelerators such Cockcroft-Walton multiplier, Van de Graaff generator, a resonance transformer, an insulating core transformer, a linear accelerator, Dynamitron, and a radio frequency accelerator, can be used. The exposure dose of the electron beams can be appropriately adjusted depending on the materials, and the thickness of the hardened protective layer, but it is preferably about 0.1 Mrad to about 30 Mrad of the electrons having the energy of generally 100 keV to 3,000 keV, preferably 100 keV to 1,000 keV. When the exposure dose is less than 0.1 Mrad, the electron beams cannot reach the inner part of the hardened protective layer, which may cause curing failures in the deep part of the hardened protective layer. Therefore, such exposure dose is not preferable. When the exposure dose is more than 30 Mrad, the electron beams reach the aforementioned charge-transporting layer and/or charge-generating layer, which may adversely affect the materials for forming these layers. Therefore, such exposure dose is not also preferable.

The temperature of the hardened protective layer (photoconductor) is increased by the influence of the heat rays and the like generated from the light source, when the UV rays or ionizing radiation is applied. When the temperature at the surface of the photoconductor is excessively elevated, shrinkage of the hardened protective layer tends to occur during hardening thereof, and low molecular components contained in the adjacent layer are transferred into the hardened protective layer, which may cause hardening failures, or lower electric properties of the resulting electrophotographic photoconductor. Therefore, such elevation of the temperature is not preferable. To avoid this problem, the surface temperature of the photoconductor during UV radiation may be set at 100° C. or lower, preferably 80° C. or lower. As a method for cooling the surface of the photoconductor, a method for cooling by inserting a cooling agent in the inner space of the photoconductor, or method for cooling by a gas or fluid present in the inner space of the photoconductor can be used.

Post heating may be performed on the hardened protective layer, which has been hardened (cured), if necessary. For example, in the case where a large amount of the residual solvent is remained in the film, which may cause deterioration in the electric properties of the resulting photoconductor, or time degradation, it is preferred that the residual solvent be evaporated by the post heating.

The thickness of the hardened protective layer is preferably 0.5 μm to 15 μm, more preferably 2 μm to 10 μm, in view of the protection of the photosensitive layer. In the case where the hardened protective layer is thin, the hardened protective layer cannot protect the photosensitive layer from the mechanical abrasion caused by a member directly in contact with the photoconductor, or electric discharge performed from a short range by a charger or the like, and moreover leveling is not easily performed during the formation of a film, which may cause the surface defects, e.g. roughness of the surface, like a surface texture of an orange zest. When the hardened protective layer is thick, the total thickness of the photoconductor layer becomes thick, which lowers the image reproducibility due to diffusion of electric charge. Therefore, it is not preferable. Note that, in the case where the thickness of the hardened protective layer is larger than the thickness of the photosensitive layer, the tendency that the charge in the bright region increases tends to be more significant, and therefore it is not preferable. In the present invention, the aforementioned adverse effects can be avoided when the thickness of the charge-transporting layer and the thickness of the hardened protective layer satisfy the relationship expressed by the following formula 4, where T1 denotes the thickness of the charge-transporting layer (μm) and T2 denotes the thickness of the hardened protective layer (μm). Therefore, it is more preferred that these layers satisfy the relationship expressed by the following formula 4.

$$T1>T2\times 2 \qquad \text{Formula 4}$$

<<Adhesive Layer>>

An adhesive layer may be provided between the hardened protective layer and the charge-transporting layer, if necessary, for preventing delamination due to an adhesion failure between them.

For forming the adhesive layer, the radical polymerizable compound may be used, or a non-crosslinkable high molecular compound may be used. The non-crosslinkable high molecular compound is appropriately selected depending on the intended purpose without any restriction, and examples thereof include polyamide, polyurethane, epoxy resin, polyketone, polycarbonate, silicone resin, acrylic resin, polyvinyl butyral, polyvinyl formal, polyvinyl ketone, polystyrene, poly-N-vinyl carbazole, polyacryl amide, polyvinyl benzal, polyester, a phenoxy resin, a vinyl chloride-vinyl acetate copolymer, polyvinyl acetate, polyphenylene oxide, polyvinyl pyridine, cellulose resin, casein, polyvinyl alcohol, and polyvinyl pyrrolidone. In any case of where the radical polymerizable compound or non-crosslinkable high molecular compound is used, the above-listed compounds may be used independently, or in combination. Moreover, the radical polymerizable compound and the non-crosslinkable high molecular compound may be used in combination as long as sufficient adhesion can be attained. Of course, the electron-transporting material described earlier can be used independently for the adhesive layer, or in combination with the aforementioned compounds. Furthermore, additives may be appropriately selected and used for improving adhesion.

The adhesive layer can be formed by applying a coating liquid, which is prepared by dissolving or dispersing the appropriately formulated compounds in a solvent (e.g. tetrahydrofuran, dioxane, dichloroethane, and cyclohexane), by dip coating, bead coating, ring coating, or the like. The thickness of the adhesive layer is preferably 0.1 μm to 5 μm, more preferably 0.1 μm to 3 μm.

<<Undercoat Layer>>

An undercoat layer may be provided between the conductive support and the photosensitive layer in the electrophotographic photoconductor of the present invention. The undercoat layer generally contains a resin as a main component, and such resin is preferably a resin that is highly resistant to general organic solvents, for considering that the photosensitive layer will be applied thereon using a solvent. Examples of such resin include: water-soluble resins such as polyvinyl alcohol, casein, and sodium polyacrylate; alcohol-soluble resins such as copolymer nylon, methoxymethylated nylon; and curable resins capable of forming three-dimensional network structures, such as polyurethane, melamine resins, phenol resins, alkyd-melamine resins, isocyanate, and epoxy resins. Moreover, the undercoat layer may contain a powdery pigment of metal oxide such as titanium oxide, silica, alumina, zirconium oxide, tin oxide, and indium oxide for preventing formations of interference fringes, and reducing residual potential.

Moreover, the undercoat layer can be formed by the same coating methods using the same solvents as in the photosensitive layer. As the undercoat layer, a silane-coupling agent, a titanium-coupling agent, a chromium-coupling agent or the like can be used. Other than those mentioned above, a layer prepared by providing $Al_2O_3$ by anodic oxidation, a thin film prepared by providing an organic material (e.g. polyparaxylylene (parylene)) or inorganic material (e.g. $SiO_2$, $SnO_2$, $TiO_2$, ITO, and $CeO_2$) by vacuum deposition and the like are preferably used. Moreover, conventional undercoat layers, which are formed by using conventional materials and methods, can also be used.

The thickness of the undercoat layer is preferably 0 μm to 5 μm.

<<Blocking Layer>>

The blacking layer can be provided between the conductive support and the undercoat layer, or between the undercoat layer and the charge-generating layer. The blocking layer is provided for preventing the injection of holes from the conductive support, and a main purpose for providing the blocking layer is to prevent background depositions on the resulting photoconductor. The blocking layer generally contains a binder resin as a main component. Examples of the binder resin include polyamide, alcohol-soluble polyamide (soluble nylon), water-soluble polyvinyl butyral, polyvinyl butyral, and polyvinyl alcohol.

As a method for forming the blocking layer, the aforementioned methods, and coating methods known in the art can be used. A thickness of the blocking layer is preferably 0.05 μm to 2 μm. By providing a two layer structure of the blocking layer and the undercoat layer, the effect of preventing background depositions significantly increases, but it may increase the adverse effect due to increase in the residual potential. Therefore, it is advised that whether this two-layer structure is provided is determined under the consideration of the formulations and thicknesses of the blocking layer and the undercoat layer.

<Additives>

An antioxidant can be added to each layer, such as the hardened protective layer, the photosensitive layer, and the undercoat layer, for improving the resistance to environment, especially, improving stability of image qualities.

Examples of the antioxidant for use include phenol compounds, paraphenylene diamines, hydroquinones, organic sulfur compounds, and organic phosphorous compounds.

Examples of the phenol compounds include 2,6-di-t-butyl-p-coresol, butylated hydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherols.

Examples of the paraphenylene diamines include N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Examples of the hydroquinones include 2,5-di-t-octylhydroquinone, 2,6-dodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropionate, distearyl-3,3'-thiodipropionate, and ditetradecyl-3,3'-thiodipropionate.

Examples of the organic phosphorous compounds include triphenylphosphine, tri(nonylphenyl)phosphine, tri(dinonylphenyl)phosphine, tricresylphosphine, and tri(2,4-dibutylphenoxy)phosphine.

These compounds are known as antioxidants for rubber, plastics, oils and fats, and commercial products thereof are readily available.

An amount of the antioxidant for use is preferably 0.01 parts by mass to 10 parts by mass, relative to the total mass of the layer to which the antioxidant is added.

(Image Forming Apparatus)

The image forming apparatus contains an electrophotographic photoconductor, a charging unit configured to charge a surface of the electrophotographic photoconductor, an exposing unit configured to expose the charged surface of the electrophotographic photoconductor to light to form a latent image, a developing unit configured to develop the latent image with a toner to form a visible image, and a transferring unit configured to transfer the visible image to a recording medium, and may further contain other units, if necessary.

As the electrophotographic photoconductor, the electrophotographic photoconductor described above is used.

Next, the electrophotographic method, and the image forming apparatus of the present invention will be more specifically explained with reference to drawings.

Figure 2:
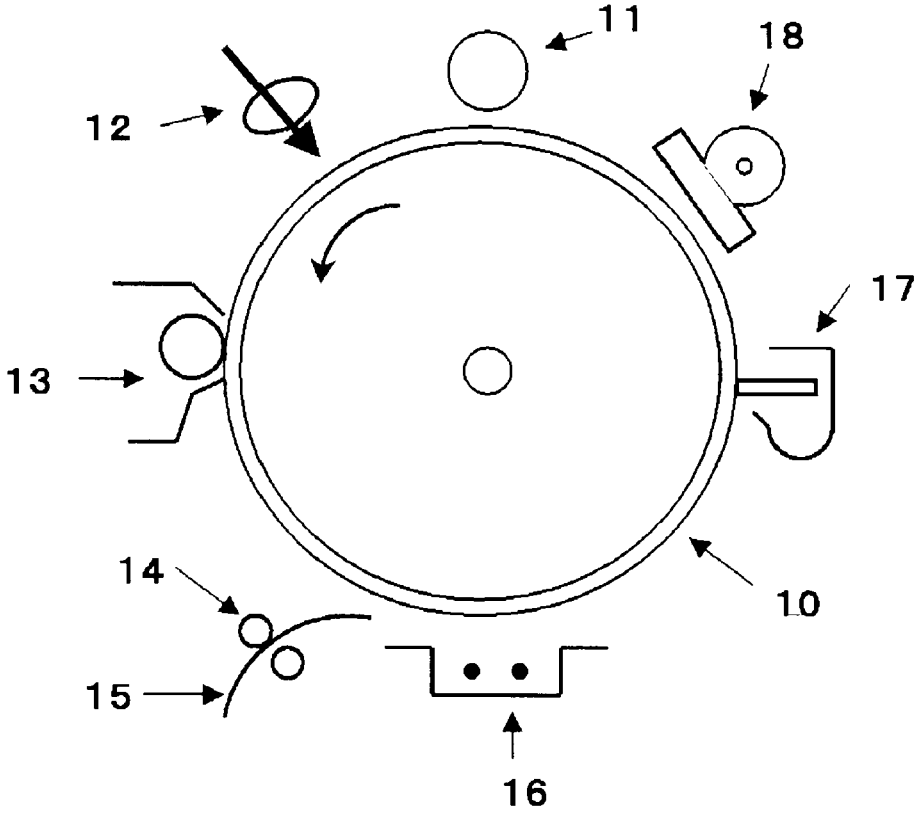
FIG. 2 is a schematic diagram illustrating one example of the image forming apparatus of the present invention.

FIG. 2 is a schematic diagram for explaining one example of the electrophotographic process, and image forming apparatus of the present invention, and the following embodiment is within the scope of the present invention.

The photoconductor 10 is rotated in the direction shown with the arrow presented in FIG. 2, and adjacent to the photoconductor 10, a charging unit 11, an imagewise exposing unit 12, a developing unit 13, a transferring unit 16, a cleaning unit 17, a diselectrification unit 18 and the like are provided. There are cases where the cleaning unit 17 and/or the diselectrification unit 18 are omitted from the image forming apparatus.

Basic operations of the image forming apparatus are as follows.

The surface of the photoconductor 10 is uniformly charged by means of the charging unit 11, followed by performing imagewise writing corresponding to an input signal by means of the imagewise exposing unit 12 to thereby form an electrostatic latent image. Then, this electrostatic latent image is developed by means of the developing unit 13 to thereby form a toner image on the surface of the photoconductor. The formed toner image is then transferred to a transferring paper 15, which has been sent to the transferring section by conveyance rollers 14, by means of the transferring unit 16. This toner image is fixed on the transferring paper by means of the fixing device (not shown). The residual toner, which has not been transferred to the transferring paper, is cleaned by the cleaning unit 17. Then, the residual potential on the photoconductor is diselectrificated by means of the diselectrification unit 18 to thereby move on to a next cycle.

As shown in FIG. 2, the photoconductor 10 has a drum shape, but the photoconductor may be in the shape of a sheet, or an endless belt. As the charging unit 11, and the transferring unit 16, other than a corotron, scorotron, and a solid state charger, a roller-shaped charging unit, a brush-shaped charging unit, and the like are used, and any of the conventional charging units can be used.

As the light sources of the imagewise exposing unit 12, the diselectrification unit 18, and the like, all luminous bodies such as fluorescent lamps, tungsten lamps, halogen lamps, mercury lamps, sodium lamps, light emitting diode (LED), laser diode (LD) (i.e. a semiconductor laser), and electroluminescence (EL) can be used. Among them, the laser diode (LD) and the light emitting diode (LED) are mainly used.

Various filters may be used for applying only the light having the predetermined wavelength, and such examples of the filters include a sharp-cut filter, a band-pass filter, a near IR-cut filter, a dichroic filter, an interference filter, and a color conversion filter.

Light is applied to the photoconductor 10 by the transferring step, diselectrifying step, cleaning step or exposing step, which also perform light irradiation. However, the application of light to the photoconductor 10 in the diselectrifying step largely gives fatigue to the photoconductor 10, especially which may reduce the charge, or increase residual potential.

Therefore, it is possible to diselectrify the photoconductor by applying reverse bias in the charging step or cleaning step, not by applying light, and such method for diselectrification may be advantageous for improving the resistance of the photoconductor.

When the electrophotographic photoconductor 10 is positively (negatively) charged to perform imagewise exposure, the positive (negative) electrostatic latent image is formed on the surface of the photoconductor. If this electrolatent image is developed with a toner (voltage detecting particles) of negative polarity (positive polarity), a positive image is obtained. If the image is developed with a toner of positive polarity (negative polarity), a negative image is obtained.

Methods known in the art are used for the operations of the developing unit and the diselectrifying unit.

The aforementioned process of the image formation is repeated, polluting materials are attached to a surface of the photoconductor Among the polluting materials attached to the surface of the photoconductor, discharge materials generated by charging, external additives contained the toner, and the like are easily influenced by humidity, and are factor for causing formation of deficient images. Paper powder is also one of the factors for formation of deficient images, the attachment of the paper powder to the photoconductor causes not only formations of deficient images, but also deterioration of abrasion resistance, and partial abrasions. Therefore, the deposition of polluted materials (contaminants) is particularly a pig problem for an image forming apparatus employing a direct transfer system that is effective for downsizing of a main body of the apparatus and reducing cost thereof. A photoconductor that prevents the deposition of such material and has mechanical resistance is desired.

The toner used for developing the image on the photoconductor 10 by means of the developing unit 13 is transferred to the transferring paper 15. However, all of the toner present on the photoconductor is not transferred, and some of the toner may remain on the photoconductor 10. Such residual toner is removed from the photoconductor 10 by the cleaning unit 17.

As the cleaning unit, those known in the art, such as a cleaning blade and a cleaning brush are used. The cleaning blade and the cleaning brush are often used in combination. When the transferring ability of the toner is poor, the residual toner remained on the photoconductor without being transferred increases, and therefore the mechanical resistance of the cleaning member tends to decrease. For this reason, it is also important to improve the transferring ability of the toner. Once the transferring ability of the toner increases, the amount of the toner waste is reduced, and as a result, the toner can be effectively used.

The image forming unit described above may be mounted to be fixed in a photocopier, a facsimile, a printer or the like. Alternatively, the image forming unit may be mounted in these devices in the form of a process cartridge.

Figure 3:
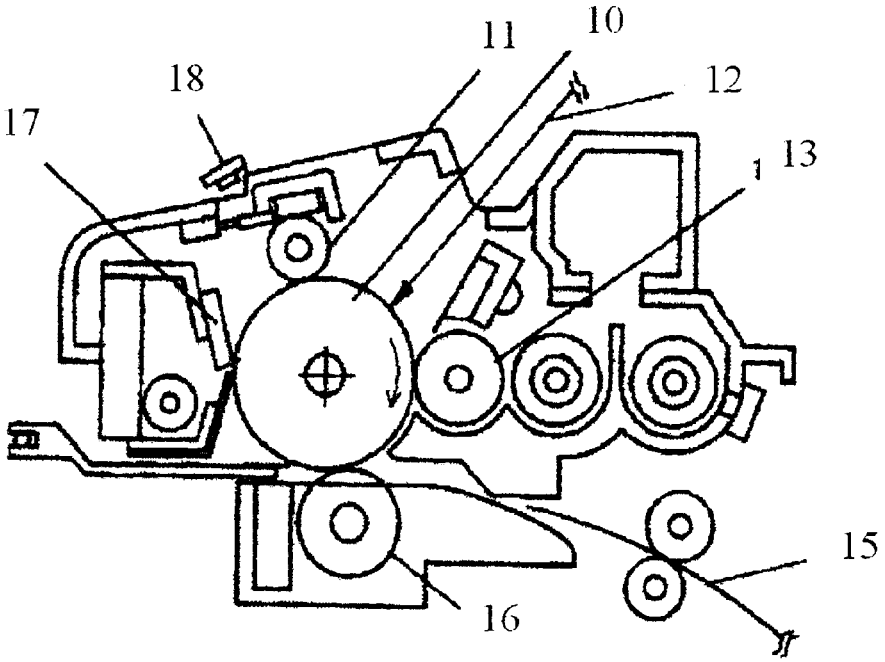
FIG. 3 is a schematic diagram illustrating one example of the process cartridge of the present invention.

The process cartridge is, for example, a device (a component) equipped with the photoconductor 10, and containing, other than the photoconductor 10, the charging unit 11, imagewise exposing unit 12, developing unit 13, transferring unit 16, cleaning unit 17, and diselectrification unit, as shown in FIG. 3.

EXAMPLES

Examples of the present invention will be explained hereinafter to more specifically describe the present invention, but these examples shall not be construed as to limit the scope of the present invention in any way. Note that, "part" and "%" described in the following Examples are all on mass basis.

At first, a synthesis example of a charge-generating material (titanyl phthalocyanine crystal) will be explained.

Synthesis Example 1

Synthesis of Titanyl Phthalocyanine Crystal

A synthesis method of a titanyl phthalocyanine used in the present invention will be explained. The synthesis was carried out based on the method described in JP-A No. 2004-83859. Specifically, 292 parts of 1,3-diiminoisoindoline and 1,800 parts of sulfolane were mixed, and to the mixture 204 parts of titanium tetrabutoxide was added dropwose under the stream of nitrogen. After the dropwise addition was completed, the temperature of the resulting mixture was gradually elevated to 180° C., and the mixture was allowed to react for 5 hours with stirring while maintaining the temperature at 170° C. to 180° C. After the completion of the reaction, the reaction mixture was left to stand for cooling, and the resulting precipitate was separated by filtration. The separated precipitate was washed with chloroform until the powder of the precipitate became the color of blue, followed by washing with methanol a few times, further washing with hot water of 80° C. a few times. Thereafter, the washed powder was dried to thereby obtain coarse titanyl phthalocyanine. The coarse titanyl phthalocyanine was then dissolved in concentrated sulfuric acid an amount of which was 20 times the amount of the coarse titanyl phthalocyanine, and the resulting solution was added dropwise to iced water an amount of which was 100 times the amount of the coarse titanyl phthalocyanine, with stirring. The resulting precipitated crystal was separated by filtration, and the separated crystal was repeatedly washed with ion-exchanged water (pH: 7.0, specific conductance: 1.0 μS/cm) until the washing liquid became neutral (pH of the ion-exchanged water after washing was 6.8, specific conductance was 2.6 μS/cm), to thereby obtain a wet cake (water paste) of a titanyl phthalocyanine pigment.

Figure 4:
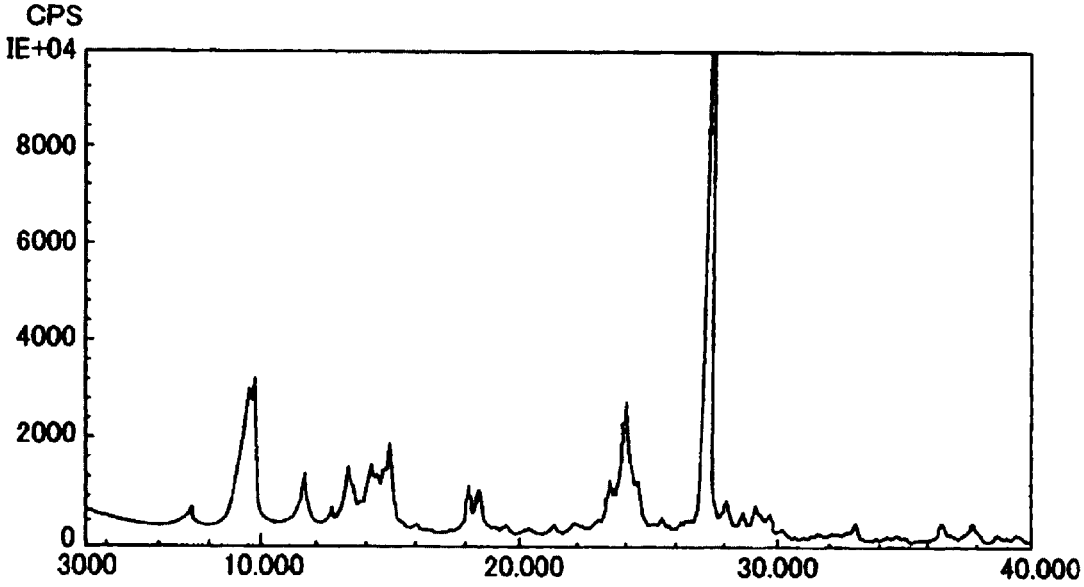
FIG. 4 is a graph showing an X-ray diffraction spectrum of the charge-generating material used in Example, and the axis of ordinate expresses counts per second (cps) and the transverse axis expresses an angle (2θ).

The obtained wet cake (water paste) (40 parts) was added to 200 parts of tetrahydrofuran. The resulting mixture was strongly stirred (2,000 rpm) at room temperature by means of a homomixer (MARKIN model, manufactured by Kenis Limited), and the stirring operation was terminated when the color of the paste was changed from dark navy blue to light blue (after 20 minutes from the start of the stirring operation), and the resultant was subjected to vacuum filtration right after the termination of the stirring operation. The obtained crystal by the filtration device was washed with tetrahydrofuran, to thereby obtain a wet cake of a pigment. The obtained pigment was dried at 70° C. under the reduced pressure (5 mmHg) for 2 days, to thereby obtain 8.5 parts of titanyl phthalocyanine crystal. Note that, the solid content of the wet cake was 15% by mass. The amount of the transformation solvent used was 33 parts by mass relative to 1 part by mass of the wet cake. Moreover, a halogen-containing compound was not used for starting materials of Synthesis Example 1. The obtained titanyl phthalocyanine powder was subjected to X-ray diffraction spectroscopy under the conditions listed below, and as a result, the spectrum of the titanyl phthalocyanine powder where Bragg angle 2θ with respect to the CuKα ray (wavelength: 1.542 Å) had the maximum peak at 27.2±0.2° and a peat at the smallest angle of 7.3±0.2°, main peaks at 9.4±0.2°, 9.6±0.2°, and 24.0±0.2°, and did not have any peak between the peak at 7.3° and the peak at 9.4°, and moreover did not have a peak at 26.3°, was obtained. The result is shown in FIG. 4.

<Conditions for X-Ray Diffraction Spectrum Measurement>

X-ray bulb: Cu
Voltage: 50 kV
Current: 30 mA
Scanning speed: 2°/min.
Scanning range: 3° to 40°
Time constant: 2 seconds <Preparation of Electrophotographic Photoconductor>

To an aluminum cylinder having a diameter of 100 mm serving as a conductive support, an undercoat layer coating liquid, a charge-generating layer coating liquid, a charge-transporting layer coating liquid, and a hardened protective layer coating liquid, each of which had the respective formulation listed below, were successively applied in this order, and then dried, to thereby form an undercoat layer having a thickness of about 3.5 μm, a charge-generating layer having a thickness of about 0.2 μm, a charge-transporting layer having a thickness of about 23 μm, and a hardened protective layer having a thickness of about 2 μm or about 0.5 μm. In this manner, a laminated photoconductor was prepared. Note that, after the coating liquid of each layer was applied and dried to touch, the undercoat layer was dried at 130° C. for 20 minutes, the charge-generating layer was dried at 95° C. for 20 minutes, and the charge-transporting layer was dried at 120° C. for 20 minutes.

The hardened protective layer was prepared by applying the hardened protective layer coating liquid onto the laminated photoconductor consisted of the conductive support, the undercoat layer, the charge-generating layer, and the charge-transporting layer, and applying light to the applied hardened protective layer coating liquid using a UV lamp (type of bulb: H bulb)(manufactured by Fusion UV Systems Japan K.K.) at the output of 200 W/cm, and illuminance of 450 mW/cm$^2$, for 30 seconds to thereby crosslink the coating liquid. Thereafter, it was dried at 130° C. for 20 minutes, to thereby prepare an electrophotographic photoconductor consisted of the conductive support, the undercoat layer, the charge-generating layer, the charge-transporting layer, and the hardened protective layer.

(Undercoat Layer Coating Liquid)

| | |
|---|---|
| Titanium oxide (CR-EL, average primary particle diameter: about 0.25 μm, manufactured by Ishihara Sangyo Kaisha, Ltd.) | 50 parts |

-continued

| | |
|---|---|
| Alkyd resin (BECKOLITE M6401-50, solid content: 50% by mass, manufactured by DIC Corporation) | 14 parts |
| Melamine resin (L-145-60, solid content: 60% by mass, manufactured by DIC Corporation) | 8 parts |
| 2-butanone | 70 parts |

(Charge-Generating Layer Coating Liquid)

In a commercially available bead mill disperser filled with PSZ balls each having a diameter of 0.5 mm, a 2-butanone solution in which polyvinyl butyral had been dissolved, and titanyl phthalocyanine crystal were charged, the mixture was dispersed for 30 minutes at the rotor revolution of 1,200 rpm to thereby prepare a charge-generating layer coating liquid.

| | |
|---|---|
| Titanyl phthalocyanine crystal | 15 parts |
| Polyvinyl butyral resin (BX-1, manufactured by Sekisui Chemical Co., Ltd.) | 10 parts |
| 2-butanone (Charge-Transporting Layer Coating Liquid) | 280 parts |
| Bisphenol-Z polycarbonate (PANLITE TS-2050, manufactured by Teijin Chemicals Ltd.) | 10 parts |
| Charge-transporting material expressed by the following structural formula | 7 parts |
| Tetrahydrofuran | 68 parts |

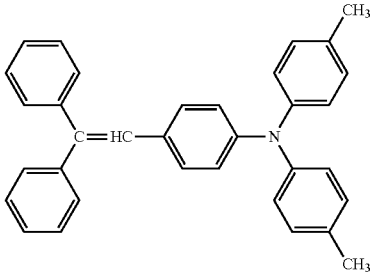

<Hardened Protective Layer Coating Liquid>

Coating Liquid for Hardened Protective Layer Containing Conductive Filler (Thickness of about 2 μm)

| | |
|---|---|
| Radical polymerizable compound containing an adamantane skeleton | 10 parts |
| 1-hydroxy cyclohexyl phenyl ketone (IRGACURE184, manufactured by Ciba Specialty Chemicals Corporation) | 0.5 parts |
| Titanium oxide (T-1, manufactured by Mitsubishi Materials electronic Chemicals Co., Ltd., average primary particle diameter: 0.02 (μm) | 2.5 parts |
| Tetrahydrofuran | 74 parts |

Coating Liquid for Hardened Protective Layer without Conductive Filler (Thickness of about 0.5 μm)

| | |
|---|---|
| Radical polymerizable compound containing an adamantane skeleton | 10 parts |
| 1-hydroxy cyclohexyl phenyl ketone (IRGACURE184, manufactured by Ciba Specialty Chemicals Corporation) | 0.5 parts |
| Tetrahydrofuran | 59.5 parts |

As the radical polymerizable compound containing an adamantane skeleton, the following compounds, Adamantanes 1 to 6, were used.

Adamantane-1 (ADAMANTATE X-A-101, manufactured by Idemitsu Kosan Co., Ltd.)

Adamantane-2 (ADAMANTATE A-201, manufactured by Idemitsu Kosan Co., Ltd.)

Adamantane-3 (manufactured by Idemitsu Kosan Co., Ltd., which was synthesized according to the method described in Example 2 of JP-A No. 2000-119220)

Adamantane-4 (ADAMANTATE X-F-102, manufactured by Idemitsu Kosan Co., Ltd.)

Adamantane-5 (manufactured by Idemitsu Kosan Co., Ltd., which was synthesized according to the method described in International Application Publication No. WO 07/020901)

Adamantane-6 (ADAMANTATE X-F-204, manufactured by Idemitsu Kosan Co., Ltd.)

As the adamantane compound that did not have radical polymerizable properties, a compound having the following structure was used.

Adamantane-7 (Adamantane, A0696 (product code), manufactured by Tokyo Chemical Industry Co., Ltd.)

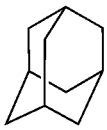

As the radical polymerizable compound that did not have an adamantane skeleton, the following compounds were used.

Trimethylol propane triacrylate (KAYARAD TMPTA, manufactured by Nippon Kayaku Co., Ltd.)

Dipentaerythritol caprolactone-modified hexaacrylate (KAYARAD DPCA-120, manufactured by Nippon Kayaku Co., Ltd.)

As the compound containing an adamantane skeleton, but not radical polymerizable, the following compound was used. APC (of the following structure, viscosity average molecular weight: 50,000)

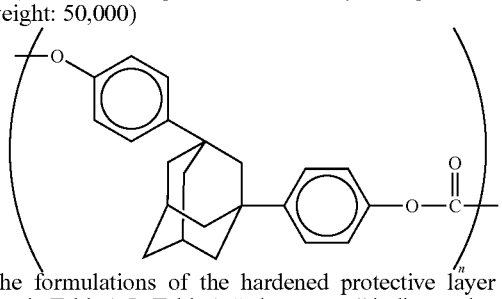

The formulations of the hardened protective layer are shown in Table 1. In Table 1, "adamantane" indicates the type of the radical polymerizable compound containing an adamantane skeleton. In Comparative Examples 1 and 2, the radical polymerizable compound without an adamantane skeleton was used, and in Comparative Examples 3 and 4, the compound containing an adamantane skeleton but not radical polymerizable was used. In the column of "adamantane 2," the compound used in combination was listed (i.e. two radical polymerizable compounds were used). In the column of "adamantane ratio," the proportion of the compound in the mixture was listed.

TABLE 1

| | Hardened protective layer | | | | |
|---|---|---|---|---|---|
| | Adamantane 1 | Adamantane 2 | Adamantane 1 ratio | Adamantane 2 ratio | Conductive filler |
| Ex. 1 | Adamantane-2 | None | 100% | 0% | Tin oxide |
| Ex. 2 | Adamantane-3 | None | 100% | 0% | Tin oxide |
| Ex. 3 | Adamantane-5 | None | 100% | 0% | Tin oxide |
| Ex. 4 | Adamantane-6 | None | 100% | 0% | Tin oxide |
| Ex. 5 | Adamantane-1 | Adamantane-2 | 50% | 50% | Tin oxide |
| Ex. 6 | Adamantane-4 | Adamantane-5 | 50% | 50% | Tin oxide |
| Ex. 7 | Adamantane-2 | None | 100% | 0% | None |
| Ex. 8 | Adamantane-3 | None | 100% | 0% | None |
| Ex. 9 | Adamantane-5 | None | 100% | 0% | None |
| Ex. 10 | Adamantane-6 | None | 100% | 0% | None |
| Comp. Ex. 1 | TMPTA | None | 100% | 0% | Tin oxide |
| Comp. Ex. 2 | DPCA-120 | None | 100% | 0% | Tin oxide |
| Comp. Ex. 3 | APC | None | 100% | 0% | None |
| Comp. Ex. 4 | Adamantane-7 | TMPTA | 50% | 50% | None |

<Evaluation Using Actual Device>

The above-prepared electrophotographic photoconductor was used, and evaluated. A paper running test on an actual device was performed, and a toner transferring rate, a film abraded amount, and image quality were evaluated before and after the running test.

Specifically, the aforementioned electrophotographic photoconductor was mounted to an electrophotographic process cartridge, and IMAGIO Neo 753 manufactured by Ricoh Company Limited was used as an image forming apparatus to run 300,000 pieces (50,000 pieces in Examples 7 to 10, and Comparative Examples 3 and 4) of paper (A4, MyPaper manufactured by Ricoh Business Expert, Ltd.) for testing. Before and after the test, the abraded amount measurement, the transferring rate measurement, and image evaluation were performed.

(Measurement of Transferring Rate)

The transferring rate was calculated by the following equation.

$$\text{Transferring rate} = 1 - \langle \text{rate of residual toner after transferring} \rangle$$

$$= 1 - \left\langle \frac{(\text{residual toner after transferring } M/A)}{(\text{toner prior to transferring } M/A)} \right\rangle$$

Note that, the residual toner after transferring means a portion of the toner remained on the photoconductor without being transferred after transferring to paper was performed. Moreover, M/A indicates a mass of the toner on the photoconductor per unit area, ($mg/cm^2$).

The procedure of the measurement will be explained next. A transferring rate evaluation chart in which solid images each having an imaging area of 2 $cm^2$ were aligned was output, and the toner image formed on the photoconductor was transferred onto a transfer paper. Immediately after the transfer of the toner, the device was stopped. Then, the residual toner was remained on the photoconductor. The residual toner was removed from the photoconductor using an adhesive tape, and the residual toner M/A on the photoconductor was determined. The residual toner amount M/A after transferring was calculated from the image density of the residual toner after transferring (residual toner ID) by calculating coefficient from a plot of the residual toner ID and the amount of the toner. Moreover, the toner MIA before transferring was calculated by determining the amount of the toner on the photoconductor before transferring.

(Measurement of Abraded Amount)

After running 300,000 (50,000) pieces of paper, the photoconductor was taken out, and the abraded amount was determined based on the difference in the thickness of the photoconductor before and after the running test. For the measurement of the thickness of the photoconductor, an eddy current film thickness tester, FISCHER SCOPE MMS (manufactured by Fischer Instruments K.K.) was used.

(Image Quality Evaluation)

A test chart No. 3 designated by The Imaging Society of Japan was output before and after running 300,000 (50,000) pieces of paper, and the image quality of each printed charts was evaluated. The evaluation was performed visually based on the following criteria:

A: Image quality was hardly degraded.

B: Image quality was slightly degraded, but there was no problem under the visual observation.

C: Degradation of the image quality was recognized by the visual observation.

D: There was a significant problem in the image quality.

The results of the abraded amount measurement, transferring rate measurement, and image quality evaluation are shown in Tables 2 and 3.

TABLE 2

| | Initial Transferring rate (%) | After running Transferring rate (%) | Abraded amount (μm) | Initial Image quality | After running Image quality |
|---|---|---|---|---|---|
| Ex. 1 | 94.3 | 92.8 | 0.6 | A | A |
| Ex. 2 | 94.9 | 93.6 | 0.6 | A | A |
| Ex. 3 | 95.5 | 94.9 | 0.7 | A | A |
| Ex. 4 | 96.0 | 95.1 | 0.9 | A | A |
| Ex. 5 | 95.1 | 92.2 | 0.6 | A | A |
| Ex. 6 | 96.3 | 94.1 | 0.9 | A | A |

TABLE 2-continued

| | Initial Transferring rate (%) | After running Transferring rate (%) | Abraded amount (μm) | Initial Image quality | After running Image quality |
|---|---|---|---|---|---|
| Comp. Ex. 1 | 91.1 | 89.2 | 1.6 | A | C |
| Comp. Ex. 2 | 92.4 | 90.1 | 1.8 | A | D |

TABLE 3

| | Initial Transferring rate (%) | After running Transferring rate (%) | Abraded amount (μm) | Initial Image quality | After running Image quality |
|---|---|---|---|---|---|
| Ex. 7 | 94.5 | 92.3 | 0.2 | A | A |
| Ex. 8 | 94.4 | 92.1 | 0.2 | A | A |
| Ex. 9 | 96.3 | 93.5 | 0.1 | A | A |
| Ex. 10 | 95.9 | 93.6 | 0.2 | A | A |
| Comp. Ex. 3 | 90.5 | 88.0 | 4.3 | A | C |
| Comp. Ex. 4 | 91.1 | 88.9 | 1.4 | A | C |

From the results of Examples and Comparative Examples, it was found that the electrophotographic photoconductor containing the hardened protect of the radical polymerizable compound containing an adamantane skeleton has excellent toner transferability. Moreover, such photoconductor has a less abraded amount and therefore has an excellent mechanical resistance. In Comparative Examples 1 and 2, white missing spots were found in the image recorded after the running, and the paper dusts and the deposition originated from the toner were observed on the photoconductor. Moreover, in Comparative Example 3, the abraded amount of the photoconductor was significantly large. The photoconductor of Comparative Example 4 had poor releasing ability and mechanical resistance compared to Examples 7 to 10 each using the radical polymerizable adamantane.

Based on these results, it was found that the electrophotographic photoconductor containing a hardened product of the radical polymerizable compound containing an adamantane skeleton is excellent in toner transferring ability, and resistance to stains, and has high mechanical resistance.

What is claimed is:

1. An electrophotographic photoconductor, comprising:

a conductive support;

a photosensitive layer provided above the conductive support; and a hardened protective layer provided above the photosensitive layer, wherein the hardened protective layer contains a hardened product of a radical polymerizable compound containing an adamantane skeleton.

2. The electrophotographic photoconductor according to claim 1, wherein the radical polymerizable compound containing an adamantane skeleton contains a fluorine atom in the adamantane skeleton.

3. The electrophotographic photoconductor according to claim 1, wherein the radical polymerizable compound containing an adamantane skeleton is a monofunctional or bifunctional compound.

4. An image forming apparatus, comprising:

an electrophotographic photoconductor;

a charging unit configured to charge a surface of the electrophotographic photoconductor;

an exposing unit configured to expose the charged surface of the electrophotographic photoconductor to light so as to form a latent electrostatic image;

a developing unit configured to develop the latent electrostatic image with a toner to form a visible image; and a transferring unit configured to transfer the visible image to a recording medium, wherein the electrophotographic photoconductor contains:

a conductive support;

a photosensitive layer provided above the conductive support; and a hardened protective layer provided above the photosensitive layer, and wherein the hardened protective layer contains a hardened product of a radical polymerizable compound containing an adamantane skeleton.

5. A process cartridge comprising:

an electrophotographic photoconductor; and at least one selected from the group consisting of a charging unit, an exposing unit, a developing unit, a transferring unit, and cleaning unit, which is mounted so as to be integrated with the electrophotographic photoconductor, wherein the electrophotographic photoconductor contains:

a conductive support;

a photosensitive layer provided above the conductive support; and a hardened protective layer provided above the photosensitive layer, and wherein the hardened protective layer contains a hardened product of a radical polymerizable compound containing an adamantane skeleton.

* * * * *